United States Patent [19]

McDaniel

[11] Patent Number: 4,694,728

[45] Date of Patent: Sep. 22, 1987

[54] FIBER OPTIC GUIDED MISSILE AIMER

[75] Inventor: Steven G. McDaniel, Huntsville, Ala.

[73] Assignee: The United States of America as represented by the Secretary of the Army, Washington, D.C.

[21] Appl. No.: 718,034

[22] Filed: Mar. 29, 1985

[51] Int. Cl.[4] ..... B64D 3/02

[52] U.S. Cl. ..... 89/1.11; 244/1372; 244/3.1

[58] Field of Search ..... 89/1.11; 244/3.1, 137 A; 269/130, 131, 43

[56] References Cited

U.S. PATENT DOCUMENTS 3,093,031 6/1963 Damm ..... 244/137 A
4,448,373 5/1984 Bates et al. ..... 244/137 A

FOREIGN PATENT DOCUMENTS 0503816 6/1954 Canada ..... 244/137 A

OTHER PUBLICATIONS

NFM North Finding Module; Sperry Gyroscope; May 1977.

Gyros, Platforms, Accelerometers; Kearfott Systems Division, General Precision Systems, Inc. 7th Ed. Nov. 1967, (pp. 26–28).

*Primary Examiner*—Frederick R. Schmidt
*Assistant Examiner*—Robert A. Rose
*Attorney, Agent, or Firm*—Freddie M. Bush; James T. Deaton

[57] ABSTRACT

An aimer for a guided missile that is easily strapped on the side of a missile to provide an automatic device for aiming the missile at a target.

3 Claims, 4 Drawing Figures

FIBER OPTIC GUIDED MISSILE AIMER

DEDICATORY CLAUSE

The invention described herein may be manufactured, used, and licensed by or for the Government for governmental purposes without the payment to me of any royalties thereon.

BACKGROUND OF THE INVENTION

In the past, the aiming of a missile was done by optically determining the missile's position relative to a known baseline. The original apparatus makes use of theodolites and a cubed mirror arrangement which is well known and established, but the use of this structure is time consuming and requires known benchmarks. In view of the time required and the cumbersomeness involved in using the prior art device, there is a need for a much simplier aiming device.

With the above need in mind, it is an object of this invention to provide an aiming device that can be easily strapped on the side of a missile and can determine the initial heading of the missile in a few minutes.

Another object of this invention is to provide a guided missile aimer that can accurately align the aim of the missile.

Still another object of this invention is to provide an aimer that is an automatic device that can be simply strapped on the missile and a device that requires no special reference.

Other objects and advantages of this invention will be obvious to those skilled in this art.

SUMMARY OF THE INVENTION

In accordance with this invention, a guided missile aimer is provided that includes a gyrocompassing north finding module that has mounting means secured thereto to allow the module to be secured to the missile in a particular manner to provide a device for quickly and accurately aiming the missile.

DESCRIPTION OF THE PREFERRED EMBODIMENT

Figure 1:
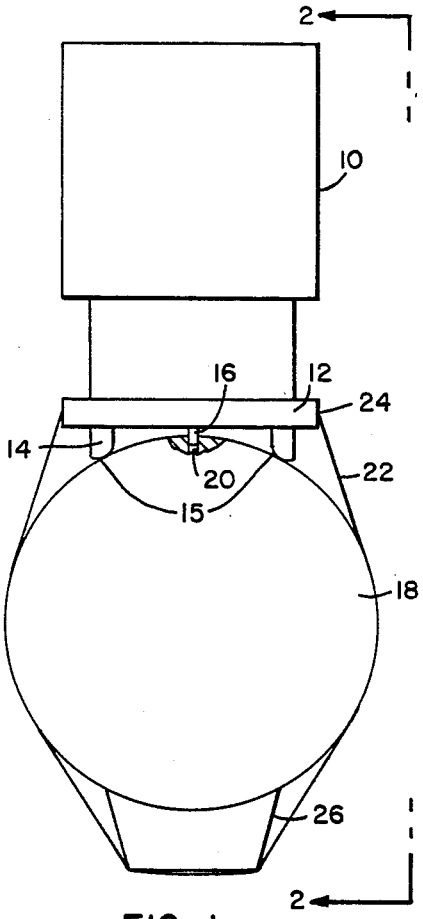
FIG. 1 is a view partially cut-away and looking down from the top of the missile and with the aimer strapped to the missile.
Figure 2:
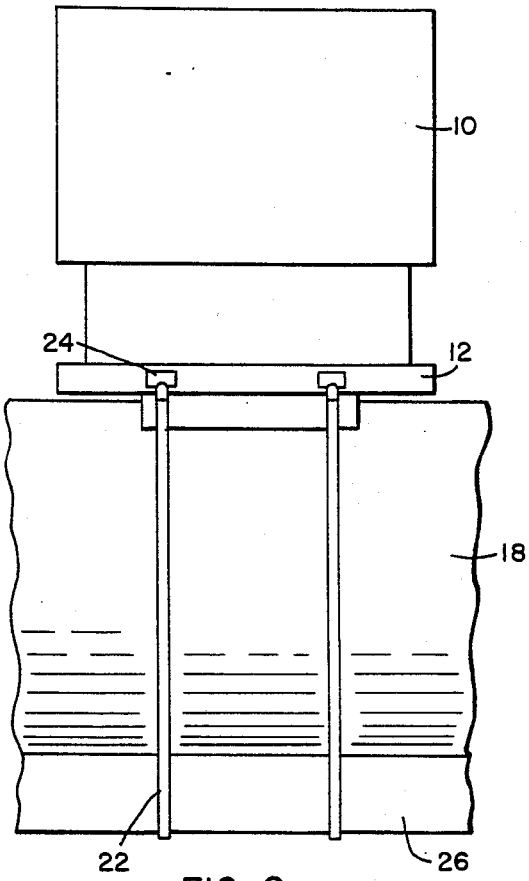
FIG. 2 is a view along line 2—2 of FIG. 1 with portions of the missile cut-away.
Figure 3:
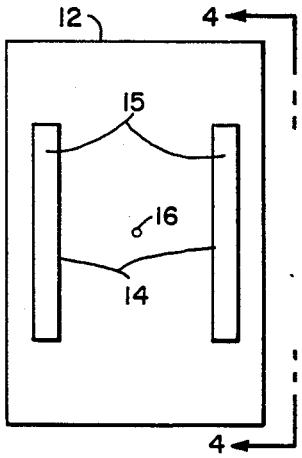
FIG. 3 is a view looking at the mounting base for the aimer.
Figure 4:
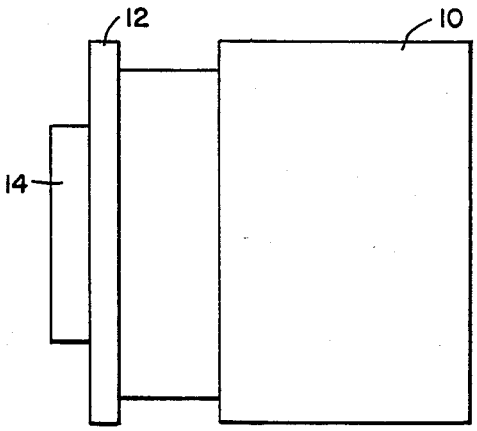
FIG. 4 is a view taken along line 4—4 of FIG. 3.

Referring now to the drawings, a portable gyrocompassing north finding module 10 of conventional structure is secured to a mounting bracket 12 such as by screws (not shown) to secure mounting bracket 12 to module 10. Mounting bracket 12 has two longitudinal rails 14 secured thereto in a conventional manner with each rail being spaced an equal distance from a central alignment pin 16. Each longitudinal rail 14 has convex curved edge 15 to allow linear contact with the skin of missile 18. By surfaces 15 being convex, the missile skin is less susceptible to have deformities imparted thereto by the unit being mounted thereon. Also, if surfaces 15 were pointed edges, these would be susceptible to making nicks in the missile skin. Pin 16 engages an opening 20 in the side of missile 18. Opening 20 is aligned in a predetermined relationship with a sensing package (not illustrated) inside missile 18. The entire alignment package is held in position on missile 18 with pin 16 engaged in opening 20 by straps 22 as illustrated in FIG. 2 with each strap including a quick release latch 24 for clamping straps 22 in position relative to missile 18. Missile 18 also has a cover 26 on a side opposite opening 20 that has been provided to this missile for covering the missile's fiberglass cable chase.

In operation, with gyrocompassing north finding module 10 strapped on missile 18 as illustrated, gyrocompassing north finding module 10 is utilized to aim missile 18 accurately at a target. Laboratory results indicate that this missile aiming system, including gyrocompassing north finding module 10 performance, has a bias of 3.19 mils clockwise and a repeatability of 0.85 mils. The bias is removed computationally in a conventional manner and the repeatability is well within the aiming specifications. By the sensing package inside missile 18, that is not shown, being aligned with opening 20 in the missile, the aligned hole with the gyrocompassing north finding module mounted thereon is used in determining the direction in which the sensing package is pointed and is accordingly used to aim the sensing package by utilizing aiming information obtained by gyrocompassing north-finding module 10 to the sensing package inside missile 18 to cause missile 18 to be directed to a target.

As can be appreciated, the aimer of this invention is an automatic device that simply straps on the missile and requires no reference other than opening 20. It produces the missile heading within a few minutes (85 seconds, 3 minutes 55 seconds, or 11 minutes depending on the desired accuracy) with an accuracy of less than one gunner's mil. Therefore, it can be appreciated that this aiming device allows a missile to be accurately aimed at a target.

I claim:

1. A missile aimer for use in accurately aiming a missile comprising a gyrocompassing north finding module mounted in a housing structure, a base member secured to said housing structure on one side of said housing structure, a pair of rails mounted on the opposite side of said base member, an alignment pin mounted in said opposite side of said base member and being spaced an equal distance from each rail, and straps mounted on opposite edges of said base member for clamping said aimer to a missile, whereby when said housing and base member are mounted on a missile with the pin projecting into an alignment opening of the missile and with the rails contacting the skin of the missile and clamped relative thereto by the straps, the gyrocompassing north finding module then being adapted for allowing one to accurately aim the missile relative to a target.

2. A missile aimer as set forth in claim 1, wherein said rails each have convex surfaces for contacting the skin of a missile.

3. A missile aimer as set forth in claim 2, wherein said straps each have quick release latches for clamping the aimer about a missile.

* * * * *